US010099881B2

(12) United States Patent
Murgia Mendizabal et al.

(10) Patent No.: US 10,099,881 B2
(45) Date of Patent: Oct. 16, 2018

(54) SPLICING METHOD AND UNIT FOR SPLICING TWO PACKAGING FILMS FOR A HORIZONTAL PACKAGING MACHINE

(71) Applicant: Ulma Packaging Technological Center, S. Coop., Oñati (ES)

(72) Inventors: Aritz Murgia Mendizabal, Oñati (ES); Juan Jesús Urcelay Ezquibel, Oñati (ES); Eneko Izquierdo Ereño, Oñati (ES)

(73) Assignee: ULMA Packaging Technological Center, S. Coop., Oñati (ES)

( * ) Notice: Subject to any disclaimer, the term of this patent is extended or adjusted under 35 U.S.C. 154(b) by 0 days.

(21) Appl. No.: 15/631,721

(22) Filed: Jun. 23, 2017

(65) Prior Publication Data

US 2017/0369265 A1 Dec. 28, 2017

(30) Foreign Application Priority Data

Jun. 27, 2016 (EP) ..... 16382302

(51) Int. Cl.
*B65H 19/18* (2006.01)
*B65B 41/16* (2006.01)
(Continued)

(52) U.S. Cl.
CPC ..... *B65H 19/1836* (2013.01); *B65B 41/12* (2013.01); *B65B 41/16* (2013.01);
(Continued)

(58) Field of Classification Search
CPC .. B65H 19/102; B65H 19/1852; B65H 21/00; B65H 2301/4621; B65H 2301/4631; B65H 2301/46312
See application file for complete search history.

(56) References Cited

U.S. PATENT DOCUMENTS 4,379,012 A * 4/1983 Heymanns ..... C09J 7/02 156/157
4,878,982 A * 11/1989 Ogata ..... B65H 19/1852 156/159
(Continued)

FOREIGN PATENT DOCUMENTS

EP 1318092 A2 6/2003
JP S6077056 A 5/1985
(Continued)

OTHER PUBLICATIONS

European Search Report in corresponding European Patent Application No. 16382302.4, dated Dec. 21, 2016.

*Primary Examiner* — Mark A Osele
(74) *Attorney, Agent, or Firm* — Edell, Shapiro & Finnan, LLC

(57) ABSTRACT

Splicing method and unit for a packaging machine, whereby a first film is spliced to a second film which is a spare film. The splicing is performed by means of an adhesive element with two opposing adhesive surfaces, one for each film, and a longitudinal adhering element. First an adhesive surface is adhered to the adhering element and said adhering element moves so that the other adhesive surface comes into contact with the second film and adheres to it. Then the adhering element is separated from said second film, the adhesive element being adhered to said second film, and the first film is caused to come into contact with said adhesive element already adhered to the second film.

9 Claims, 4 Drawing Sheets

(51) Int. Cl.

| | |
|---|---|
| ***B65H 23/188*** | (2006.01) |
| ***B65B 41/12*** | (2006.01) |
| ***B65H 19/10*** | (2006.01) |
| *B65H 21/00* | (2006.01) |

(52) U.S. Cl.
CPC ..... *B65H 19/102* (2013.01); *B65H 23/1882* (2013.01); *B65H 21/00* (2013.01); *B65H 2301/463* (2013.01); *B65H 2301/4621* (2013.01); *B65H 2301/4631* (2013.01); *B65H 2301/46066* (2013.01); *B65H 2301/46312* (2013.01); *B65H 2511/142* (2013.01); *B65H 2513/51* (2013.01); *B65H 2701/1752* (2013.01); *B65H 2801/81* (2013.01)

(56) References Cited

U.S. PATENT DOCUMENTS

| | | | | |
|---|---|---|---|---|
| 5,385,622 | A * | 1/1995 | Klingebiel ..... | B65H 19/102 156/157 |
| 6,422,282 | B1 * | 7/2002 | Meinke ..... | B65H 19/102 156/157 |
| 6,502,613 | B2 * | 1/2003 | Suzuki ..... | B65H 19/102 156/157 |
| 6,533,891 | B1 * | 3/2003 | Kubinski ..... | B29C 65/5042 156/304.1 |

FOREIGN PATENT DOCUMENTS

| | | | |
|---|---|---|---|
| WO | 2010128441 | A1 | 11/2010 |
| WO | 2016066617 | A1 | 5/2016 |

* cited by examiner

SPLICING METHOD AND UNIT FOR SPLICING TWO PACKAGING FILMS FOR A HORIZONTAL PACKAGING MACHINE

CROSS-REFERENCE TO RELATED APPLICATIONS

The present application relates to and claims the benefit and priority to European Patent Application No. EP16382302.4, filed Jun. 27, 2016.

TECHNICAL FIELD

The present invention relates to splicing methods for splicing two packaging films to one another for horizontal packaging machines, and to splicing units for splicing two packaging films to one another for horizontal packaging machines.

BACKGROUND

Horizontal packaging machines use at least one packaging film for packaging the products. To supply this film, said machines comprise a feeding unit, where said film is wound in the form of a reel on a reel holder. The film is unwound and supplied by the necessary means for packaging the products by means of a film driving system or by means of turning the reel holder.

In some horizontal packaging machines, to improve production the feeding unit comprises two reel holders for being able to store a spare reel while the film on the operative reel is supplied for packaging the products. With these feeding units, machines further comprise a splicing unit in which when a first operative reel is almost spent, the film on the second spare reel is spliced to the film on this first reel, and the packaging machine can thereby continue packaging with the film on the second reel when the first reel is spent, without having to stop production to replace an empty reel with a reel that has film.

Machines comprising a splicing unit automatically performing the process of splicing the two films to one another are known, such as the one disclosed in WO2010128441A1, for example. The splicing unit is arranged on one of the sides of the roller shafts, and to splice both films together first one film is arranged on the other, and then they are welded together. Therefore, it is necessary to incorporate devices or elements that entail excessively increasing the final cost and size of the machine, as well as a more complex and expensive maintenance, which cannot always be taken on.

Other more cost-effective methods involve a user's action for splicing the two films to one another, where the splicing (attachment) of the two films is done by means of an adhesive element comprising two opposing adhesive surfaces commonly referred to as two-sided tape. An adhesive surface is adhered to one of the films and the other adhesive surface is adhered to the other film, both films thereby being spliced to one another by means of said adhesive element. First, the adhesive element is adhered to one of the films manually, and then the other film is spliced automatically. For adhering the adhesive element to the first film, the user responsible for doing it must face a series of difficulties which, if not correctly resolved, lead to an incorrect adhesion or accidental tearing of the film, for example, which would entail shutting down the machine. Accessibility to the film stands out among these difficulties: the adhesive element is adhered to the film transversely, covering most of the width of the film. Due to the configuration of horizontal packaging machines, the user has to access the entire width (bottom) of the machine (to cover the entire width of the film) from one side of the machine, which makes the attachment operation uncomfortable and difficult, which could furthermore result, should the operation fail, in the need to remove the poorly packaged product, waste the used film and feed film back into the machine again all of which, in summary, reduces the output of the packaging process and increases the cost.

SUMMARY OF THE DISCLOSURE

A method is provided in which a first packaging film being used in a packaging machine for packaging products and a second packaging film which is a spare film are spliced to one another in the packaging machine.

Splicing is performed by means of an adhesive element comprising a first adhesive surface which is adhered to the second film and a second adhesive surface opposite the first adhesive surface and which is adhered to the first film.

In the method, the second adhesive surface of the adhesive element is adhered to an adhering element of the packaging machine, the first adhesive surface of said adhesive element being exposed, the adhering element then moves to a position in which said first adhesive surface of the adhesive element comes into contact with the second film and transverse to said second film, the adhering element then moves away such that the second surface of the adhesive element is peeled off said adhering element and the adhesive element is adhered to said second film with the second adhesive surface exposed, and finally, preferably when the first film is about to be used up, contact between the first film and said exposed second adhesive surface of the adhesive element is caused for splicing both films to one another by means of the adhesive element.

Therefore, by means of using a adhering element it is no longer necessary to manually and directly adhere the adhesive element to the packaging films for splicing both films to one another, which largely reduces the risk that it is not correctly adhered and that the operation must be repeated again, or even that the machine must be shut down and part of the film has to be wasted, for example. Furthermore, the use of said adhering element makes it much easier to splice both films to one another, since it is no longer necessary for the user to cover the width of the film to do so, as occurs in the case of applying the adhesive element directly, but rather it is the adhering element that has to meet this requirement, and said adhering element can be operated as is most suited for making this operation easier.

A second aspect relates to a splicing unit for splicing two packaging films for a packaging machine. The packaging machine comprises a first reel holder for supporting a first film wound in the form of a reel, and a second reel holder for supporting a second film wound in the form of a reel, the first film being the film being used in the packaging machine for packaging the products and the second film being a spare film. The splicing unit of the machine is used for splicing both films to one another by means of an adhesive element comprising a first adhesive surface which is adhered to the second film and a second adhesive surface opposite the first adhesive surface and which is adhered to the first film.

The splicing unit comprises an adhering element for adhering the first adhesive surface of the adhesive element to the second film, and splicing means to cause contact between the two films, the adhering element comprising a main surface on which the second adhesive surface of the adhesive element is adhered.

The adhering element is suitable for moving in a guided manner to a position in which the first adhesive surface of the adhesive element comes into contact with the second film for being adhered to same, and for being separated from said second film such that the second surface of the adhesive element is peeled off said adhering element and the adhesive element is adhered to said second film with the second adhesive surface exposed. The splicing means are configured to cause contact between the two films when the first adhesive surface of the adhesive element is adhered to the second film, for splicing both films to one another by means of said adhesive element.

Therefore, with the splicing unit at least the same advantages as those discussed for the first aspect are obtained for a packaging machine with said unit.

These and other advantages and features will become evident in view of the drawings and the detailed description.

DETAILED DESCRIPTION

Figure 1:
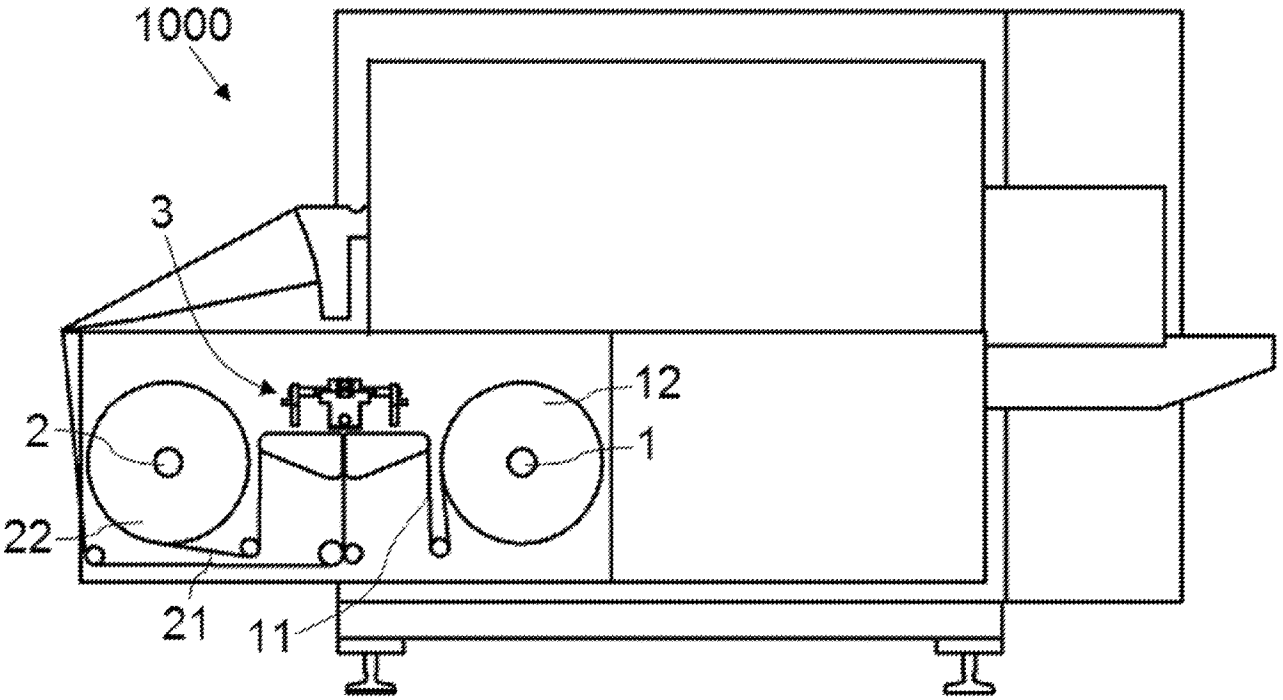
FIG. 1 shows a splicing unit according to one embodiment arranged in a packaging machine.

A splicing method is provided for splicing two films 11 and 21 to one another, for a splicing unit 3 of a packaging machine 1000 like the one shown by way of example in FIG. 1, a first film 11 being the film that is used for packaging the products and the second film 21 being a spare film. Therefore, when the first film 11 is packaging a product, the second spare film 21 can be prepared so that when the first film 11 is spent, said second film 21 takes over its function and the packaging of products can continue with said second film 21 without having to stop the packaging machine 1000 and, therefore, production. When the original second film 21 is used as a film for packaging the product, it is no longer a spare film, the original first film 11 being the spare film. In this case, the original second film 21 becomes the first film 11, and the original first film 11 becomes the second film 21. The films 11 and 12 are stored on a respective reel holder 1 and 2 in the packaging machine 1000, in the form of a reel, and the films are supplied when required by means of turning the reel holder 1 and 2 or by means of a driving system.

The splicing of the two films 11 and 21 is performed by means of an adhesive element 4 comprising a first adhesive surface which is adhered to the second film 21 and a second adhesive surface opposite the first adhesive surface and which is adhered to the first film 11.

In the method, the following steps are followed for splicing the two films 11 and 21 to one another:

the second adhesive surface of the adhesive element 4 is adhered to a adhering element 306 of the packaging machine 1000, which can be a longitudinal rod, for example, the first adhesive surface of said adhesive element 4 being exposed, the adhering element 306 moves to a position in which said first adhesive surface of the adhesive element 4 comes into sufficient contact with the second film 21 for being adhered to same and, preferably, transversely to said second film 21, the adhering element 306 is separated from the second film 21 such that the second adhesive surface of the adhesive element 4 is peeled off said adhering element 306 and the adhesive element 4 is maintained adhered to said second film 21 with the second adhesive surface exposed, and contact between the first film 11 and said exposed second adhesive surface of the adhesive element 4 is caused for splicing both films 11 and 21 to one another by means of the adhesive element 4.

The adhering element 306 comprises a main surface on which the second adhesive surface of the adhesive element 4 is adhered. The packaging machine 1000 can further comprise a respective support 5 for each film 11 and 21, such that the adhering element 306 acts on an area of the second film 21 supported on the corresponding support 5. The supports 5 can be part of the splicing unit 3 or can be independent from said splicing unit 3.

Figure 2:
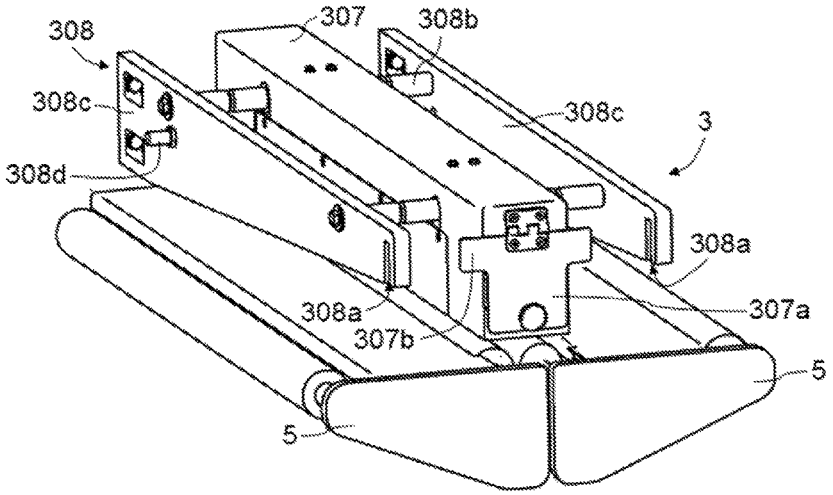
FIG. 2 shows a perspective view of the splicing unit of FIG. 1.
Figure 3:
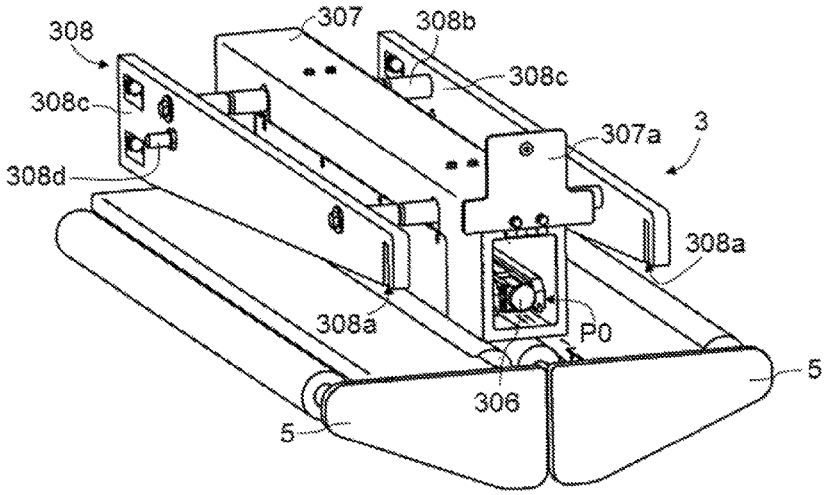
FIG. 3 shows the splicing unit of FIG. 2, with a cover for a support of said unit open and with an adhering element in an initial position.

In a preferred embodiment, the adhering element 306 is associated with the packaging machine 1000 in an initial position P0 shown by way of example in FIGS. 2 and 3, and for adhering the adhesive element 4 to the adhering element 306, said adhering element 306 moves from the initial position P0 to an access position P1 where the main surface of said adhering element 306 on which said second adhesive surface is adhered is accessible by a user, such that said user can more readily and comfortably adhere the second adhesive surface of the adhesive element 4 to said adhering element 306. To that end, the user can pull on one end of the adhering element 306 and thereby take it to the access position P1, which is shown by way of example in FIG. 4.

The access position P1 can be a position in which the adhering element 306 is somehow attached to the packaging machine 1000 (at the end not operated by the user, for example), or it can even be a position in which it has no connection whatsoever with the packaging machine 1000, as may be the case of a user holding it in their hand, for example, or arranging it on a table or somewhere else to act on it, which would make adhesion of the adhesive element to said adhering element 306 even easier. The access position P1 can be one required or desired by the corresponding user. In any case, the access position P1 is a position in which access to the entire surface on which a user has to adhere the adhesive element 4 manually (in this case the main surface of the adhering element 306) is improved, avoiding having to deal with the width (bottom) of the packaging machine 1000 like in the prior art, where the user directly adheres the adhesive element 4 on the second film 21, which in turn is arranged in a specific position in the horizontal packaging machine 1000. Therefore, as a result of using a adhering element 306 and of being able to arrange said adhering element 306 in an access position P1, a user can readily adhere the second adhesive surface of the adhesive element 4 to the preferably longitudinal main surface of said adhering element 306, and once adhered, the first adhesive surface of said adhesive element 4 is simultaneously exposed. With the adhesive element 4 thereby adhered to the adhering element 306, said adhering element 306 moves to the initial position P0, and then from said initial position P0 to the position in which the first adhesive surface of the adhesive element 4 comes into contact with the second film 21 enough so as to be adhered to said second film 21. Preferably, the adhering element 306 finally moves back to the initial position P0 in order to be prepared for when another adhesive element 4 must be adhered to it for another process of splicing two films 11 and 21.

Once the first adhesive surface of the adhesive element 4 comes into contact with the second film 21 enough so as to be adhered to said second film 21 (and/or after the time required for said adhesion has passed), the adhering element 306 is separated from said second film 21 such that the adhesive element is adhered to said second film 21 with the second adhesive surface being exposed when it is peeled off the adhering element 306, and preferably moves back to the initial position P0, in order to be prepared for when another adhesive element 4 must be adhered to it. Preferably, the adhesive element 4 is adhered transversely to said spare film 11, 21, such that covers all or most of the width of said spare film 11, 21. As discussed, the second adhesive surface of the adhesive element 4 is furthermore exposed, such that the adhesive element 4 is thus adhered to the second film 21 on one side, and is prepared for being able to be adhered to the first film 11 (with the second adhesive surface 21). Therefore, the risk that the adhesive element 4 is not correctly adhered to the second film 21 and that the packaging machine 1000 has to be shut down as a result, for example, significantly decrease. Then the first film 11 and the second adhesive surface of the adhesive element 4 are caused to come into contact with one another, said second adhesive surface thereby being adhered to said first film 11, and the two films 11 and 21 thereby being spliced to one another by means of the adhesive element 4. Preferably the adhesive element 4 is also adhered transversely to said first film 11, such that it covers all or most of the width of said first film 11.

This reduces the risk of defective splicing between two films 11 and 21 in a packaging machine 1000 in a simple manner and with smaller cost increase compared with a completely automatic solution for example (completely automatic solution being understood as user intervention occurring for the sole purpose of correctly positioning both films 11 and 21 in the packaging machine 1000).

The adhesive element 4 is preferably two-sided tape. Two-sided tape generally has a protective strip adhered to each adhesive surface of the adhesive element 4, with a low bond capacity so they can be easily peeled off the respective adhesive surfaces, and furthermore without said adhesive surfaces losing their adherent properties. Therefore, in the process of adhering the adhesive element 4 to the adhering element 4 the user preferably first peels the protective strip off the second adhesive surface, then adheres said second adhesive surface to the main surface of the adhering element 306, and finally peels the protective strip off the first adhesive surface. As a result, the adhesive element 4 is adhered by means of its second adhesive surface to the adhering element 306, whereas the first adhesive surface is exposed for being able to then be adhered to the second spare film 21.

To make it easier to peel the adhesive element 4 off the adhering element 306, said adhering element 306 and/or adhesive element 4 are configured so that the bond strength between the second film 21 and the first adhesive surface of said adhesive element 4 adhered to said second film 21 is greater than the bond strength between the main surface of the adhering element 306 and the second adhesive surface of said adhesive element 4 adhered to said main surface of the adhering element 306, such that when the adhering element 306 is separated from the second film 21, the first surface of the adhesive element 4 is adhered to said second film 21 and the second surface of the adhesive element 4 is peeled off said main surface of the adhering element 306. As an example, if both adhesive surfaces of the adhesive element 4 have the same adhesive property, the main surface of said adhering element 306 has adherent properties that are inferior to the adherent properties of the second film 21, or a material that meets said requirements and acts as the main surface is previously adhered to the adhering element 306. Furthermore, for separating the adhering element 306 from the second film 21, first the second film 21 is preferably held down by means of at least one holding-down element 309, preferably a holding-down element 309 on each side of the adhering element 306, preventing the movement of the second film 21 at least during the separation of the adhering element 306. Furthermore, for separating the adhering element 306 from the second film 21, first preferably one end of said adhering element 306 is separated and then the other end is, assuring to a larger extent that the second adhesive surface will peel off the main surface of said adhering element 306.

Figure 4:
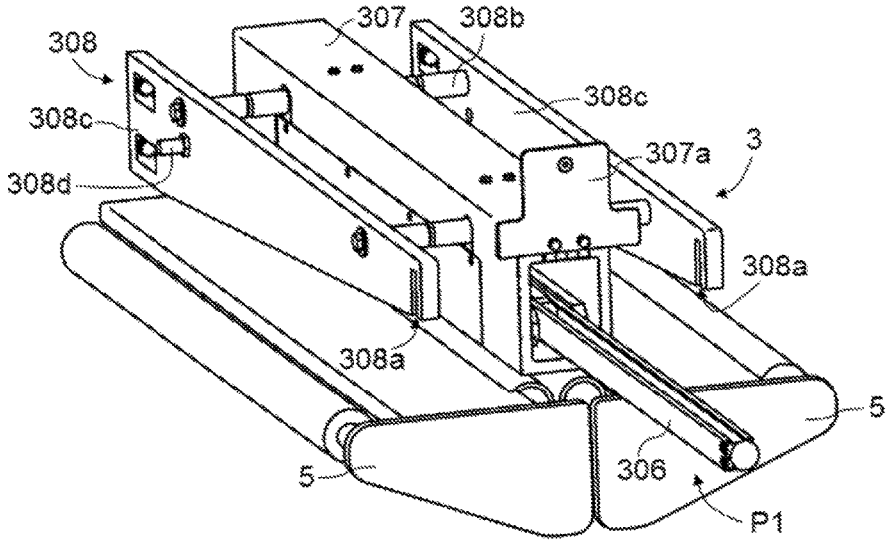
FIG. 4 shows the splicing unit of FIG. 2, with the cover open and with the adhering element in an access position.

The packaging machine 1000 further may further comprise a support 307 configured at least partially house the adhering element 306. The support 307 is attached with freedom of movement to a structure 308 of the packaging machine 1000, such that it is suitable for moving in a positioning direction X guided by said structure 308. The structure 308 comprises at least one guiding element 308*b* in the form of a pin, extending transverse to the adhering element 306. The adhering element 306 is attached with freedom of longitudinal movement with respect to said support 307, such that in a preferred embodiment of the method the adhering element 306 moves longitudinally with respect to said support 307 to go from the initial position P0 to the access position P1 and vice versa, and as discussed, said movement of the adhering element 306 may be performed manually. The movement from the initial position P0 to the access position P1 and vice versa will be completely longitudinal with respect to the support 307 provided that the adhering element 306 remains associated with said support in the access position P1; otherwise, the longitudinal movement will take place only during the cooperation between the support 307 and the adhering element 306. The support 307 can further comprise a cover 307*a*, and for being able to access the adhering element 306 to move it to the access position P1 from the initial position P0, the user must first open said cover 307*a* (as shown in FIGS. 3 and 4).

Figure 5:
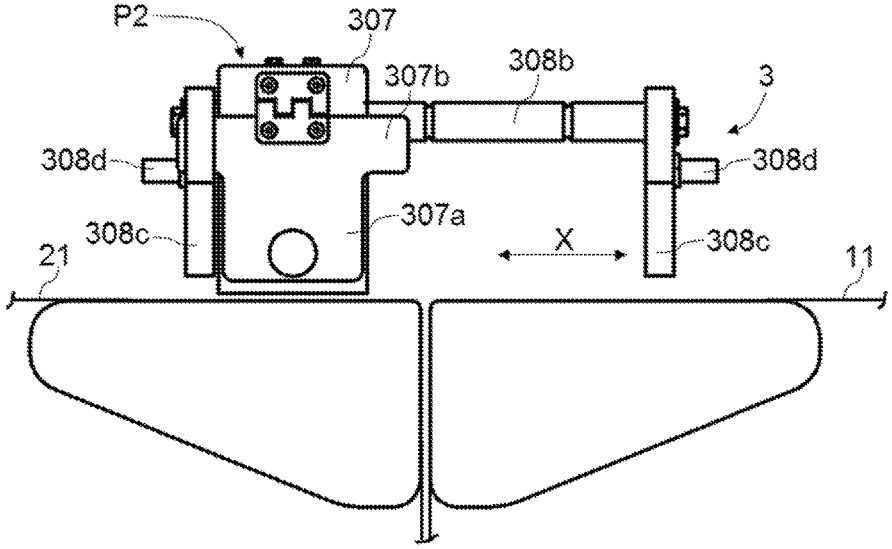
FIG. 5 shows a front view of the splicing unit of FIG. 2, with the adhering element in an adhering position.
Figure 6:
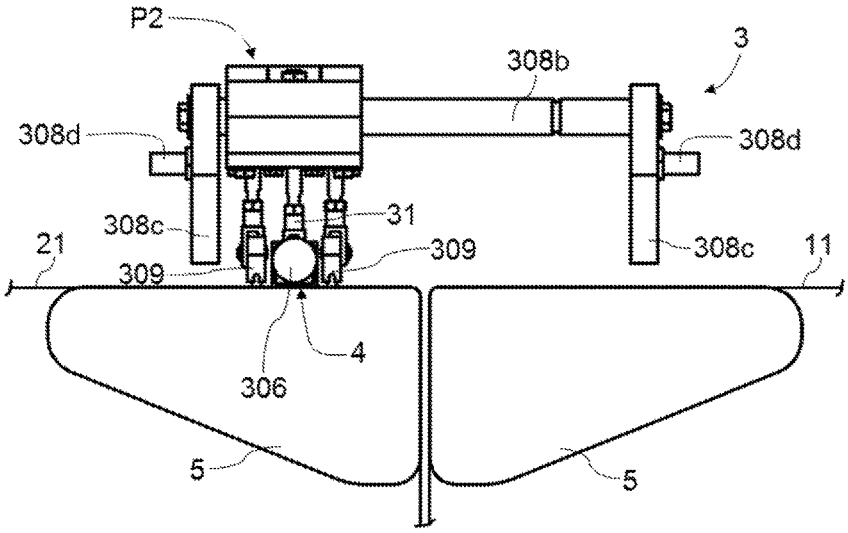
FIG. 6 shows the splicing unit of FIG. 5 without the support, and with the adhering element in contact with a film.
Figure 7:
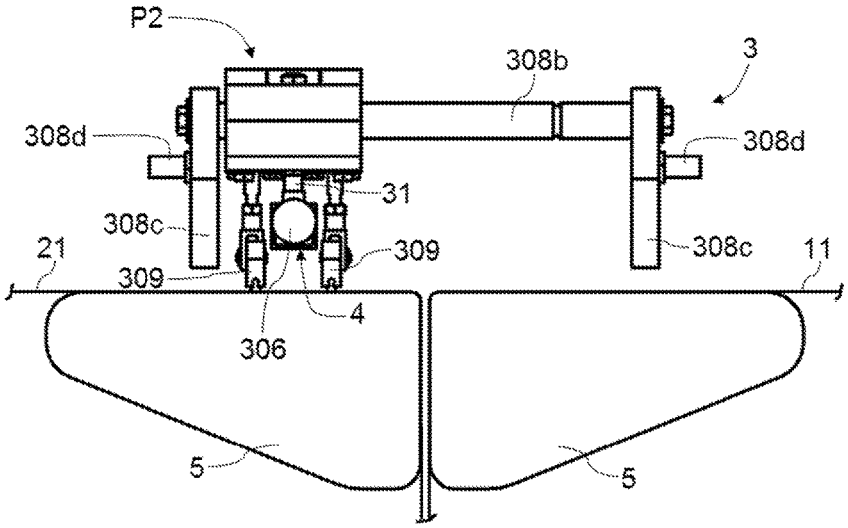
FIG. 7 shows the splicing unit of FIG. 5 without the support, and with a hold-down element holding down the film.

In one embodiment, with the adhering element 306 in the initial position P0 and the adhesive element 4 adhered to it, movement of the support 307 (and therefore of the adhering element 306) in the positioning direction X is caused manually, although it could be automatically, the movement of the support 307 to a adhering position P2 in the positioning direction X shown by way of example in FIGS. 5 to 7 is caused for adhering the adhesive element 4 to the second film 21. In said adhering position P2, the main surface of the adhering element 306 is facing the second film 21 (specifically the first adhesive surface of the adhesive element 4). The splicing unit 3 is arranged in the packaging machine 1000 preferably between the two reel holders 1 and 2, as shown in the drawings, such that depending on the film acting as a second film 21, the adhering position P2 will be on one side or another in the positioning direction X with respect to the initial position P0. Furthermore, any position that is between these two adhering positions P2, and not a specific position between both adhering positions P2, can be understood as initial position P0.

Although reference has been made to the initial and adhering positions P0 and P2 as positions of the adhering element 306, positions of the support 307 are also considered since the adhering element 306 moves to the adhering position P2 provided that it is housed in the support 307, and therefore integral with said support 307.

In other embodiments, the movement of the support 307 (and the adhering element 306) from the initial position P0 to the adhering position P2 can be rotational with respect to a fixed shaft, for example.

With the adhering element 306 in the adhering position P2, in one embodiment said adhering element 306 moves vertically with respect to the support 307, towards the second film 21, at least until the first adhesive surface of the adhesive element 4 is adhered by contact to said second film 21, as depicted in FIG. 6 (where the support 307 is not shown so that the position of the adhering element 306 can be distinguished more clearly). Then the reverse movement of the adhering element 306 is performed until being housed again in the support 307, and said movement is performed such that the second adhesive surface of the adhesive element 4 is peeled off the adhering element 306, said adhesive element 4 thereby being adhered to the second film 21 with said exposed second adhesive surface. In one embodiment the movement is performed causing first the separation of one end of the adhering element 306 and then the other, as discussed above, and with the second film 21 preferably held down to prevent the movement thereof at least during the separation of the adhering element 306.

The vertical movement of the adhering element 306 with respect to the support 307 is preferably performed automatically, i.e., caused by automatic actuation means. In the one embodiment the vertical movement of the adhering element 306 with respect to said support 307 towards the second film 21 is furthermore performed only if the presence of said adhering element 306 and/or support 307 in the adhering position P2 has been detected.

In summary, according to some embodiments the splicing method is performed according to the following steps, and in that order:

1. The adhering element 306 moves from the initial position P0 to the access position P1.
2. The second adhesive surface of the adhesive element 4 is adhered to the adhering element 306 (to a main surface of said adhering element 306), and, where appropriate, is exposed the first adhesive surface of the adhesive element 4.
3. The adhering element 306 moves from the access position P1 to the initial position P0.
4. The adhering element 306 moves from the initial position to an adhering position P2.
5. The adhering element 306 moves from the adhering position P2 to a position in which the first adhesive surface of the adhesive element 4 is adhered to the second film 21. In this process the second film 21 is kept secured, at least in the part in which said second film 21 and the first adhesive surface are in contact.
6. The adhering element 306 is separated from the second film by moving it to the adhering position P2.
7. The adhering element 306 moves out of the adhering position P2 in the positioning direction X.
8. Contact between the first film and the second adhesive surface of the adhesive element 4 (which is adhered to the second film 21 by means of its first adhesive surface) is caused. This step could be performed before, during or after the preceding step.

A second aspect relates to a splicing unit 3 for splicing packaging films for a packaging machine 1000, where the method of the first aspect is implemented.

The packaging machine 1000 comprises a first reel holder 1 for supporting a first film 11 wound in the form of a reel 12, and a second reel holder 2 for supporting a second film 21 wound in the form of a reel 22, the first film 11 being the film being used in the packaging machine 1000 for packaging the products and the second film 21 being a spare film. The "exchange" of functions of the films has been discussed above with respect to the first aspect of the invention and will not be explained here again.

The splicing unit 3 splices both films 11 and 21 to one another by means of an adhesive element 4 comprising a first adhesive surface which is adhered to the second film 21 and a second adhesive surface opposite the first adhesive surface and which is adhered to the first film 11.

The attachment unit 3 comprises a longitudinal adhering element 306 for adhering the first adhesive surface of the adhesive element 4 to the second film 21, and splicing means to cause contact between the two films 11 and 21. Said splicing means is configured to cause said contact when the first adhesive surface of the adhesive element 4 is adhered to the second film 21, such that the second adhesive surface of the adhesive element comes into contact with the first film 11, and both films 11 and 21 are spliced to one another by means of said adhesive element 4.

The adhering element 306 comprises a main surface suitable for receiving the second adhesive surface of the adhesive element 4, said adhesive element 4 thereby being adhered to the adhering element 306. Since the second adhesive surface is adhered to the adhering element 306, the first adhesive surface, opposite the second adhesive surface, is exposed for being able to be adhered in that manner to the second film 21. If said first adhesive surface has a protective strip or equivalent, it must be removed to leave said first adhesive surface exposed, as also discussed for the first aspect above.

The adhering element 306 is suitable for moving in a guided manner to a position in which, with the adhesive element 4 adhered to it, the first adhesive surface of the adhesive element 4 comes into sufficient contact with the second film 21 for being adhered to same, preferably transversely and taking up all or most of the width of said film 21, and for being separated from said second film 21 such that the second adhesive surface of the adhesive element 4 is peeled off said adhering element 306 and the adhesive element 4 is adhered to said second film 21 with the exposed second adhesive surface. To enable this peeling, said adhering element 306 and/or adhesive element 4 are configured so that the bond strength between the second film 21 and the first adhesive surface of said adhesive element 4 adhered to said second film 21 is greater than the bond strength between the main surface of the adhering element 306 and the second adhesive surface of said adhesive element 4 adhered to said main surface of the adhering element 306, such that when the adhering element 306 is separated from the second film 21, the first surface of the adhesive element 4 is adhered to said second film 21 and the second surface of the adhesive element 4 is peeled off said main surface of the adhering element 306. As an example, if both adhesive surfaces of the adhesive element 4 have the same adhesive property, the main surface has adherent properties that are inferior to the adherent properties of the second film 21, or a material complying with said requirements and acting as the main surface is previously adhered to the adhering element 306.

The splicing unit 3 comprises a first actuator 31 associated with a first end of the adhering element 306 and a second actuator (not depicted in the drawings) associated with a second end of the adhering element 306, opposite the first end of the adhering element 306, and control means communicated with both actuators. The actuators cause at least part of the movement of the adhering element 306 for moving it closer to and away or separating it from the second film 21, said part comprising the last portion of the movement when being moved closer and the first portion when being moved away. Said control means is configured to cause simultaneous actuation of both actuators for moving the adhering element 306 closer to the second film 21, assuring that the entire length of the adhesive element 4 simultaneously comes into contact with the second film 21, and delayed actuation of one of the actuators with respect to the actuation of the other actuator for moving away or separating said adhering element 306 from said second film 21 progressively, making it easier to peel the adhesive element 4 off the adhering element 306.

The adhering element 306 is suitable for moving from the initial position P0 to the access position P1 described in reference to the first aspect, the adhesive element 4 being adhered to the main surface of the adhering element 306 with said adhering element 306 in said access position P1.

The splicing unit 3 comprises a support 307 for housing the adhering element 306 when it is in the initial position P0, and the adhering element 306 is attached to said support 307 with freedom of longitudinal movement. Therefore, the adhering element 306 moves longitudinally with respect to said support 307 when going from the initial position P0 to the access position P1 and vice versa. Preferably, the splicing unit 3 comprises a structure 308 in turn comprising at least one guiding element 308*b*, in the form of a pin, transverse to the adhering element 306, and the support 307, together with said adhering element 306, is configured for moving in a positioning direction X guided by the guiding element 308*b* of the structure 308, from the initial position P0 (in both directions). The support 307, and therefore the adhering element 306, is suitable for moving in a manner that is guided by the structure 308 to an adhering position P2 in which it is facing the second film 21. When the second film 21 (the film acting as the spare film) is to the right of the initial position, the adhering position P2 is also to the right of the initial position P0. However, when the second film 21 (the film acting as the spare film) is to the left of the initial position, the adhering position P2 is also to the left of the initial position P0. Therefore, the splicing unit 3 is configured for being able to splice two films 11 and 21 to one another, continuously, without having to stop the packaging process. From the adhering position P2 until coming into contact with the second film 21, and vice versa, the adhering element 306 moves with respect to the support 307, preferably in a vertical manner. This movement is caused by the two actuators discussed above, controlled by the corresponding control means. The structure 308 of the splicing unit 3 comprises a support 308*c* at each end of the guiding element 308*b*, whereby it is attached to the general structure of the machine 1000.

As discussed with respect to the first aspect, the support 307 can further comprise a cover 307*a*, and for being able to access the adhering element 306 to move it to the access position P1 from the initial position P0, the user must first open said cover 307*a*.

That which has been discussed with respect to the positions P0, P1 and P2 referring to the first aspect is also valid for the second aspect and will not be described in detail again.

The splicing unit 3 comprises at least one detector 308*d* for detecting if the adhering element 306 is in the adhering position P2 on the second spare film 21, and the control means communicated with the actuators are also communicated with said detector 308*d*. Said control means is configured to cause the movement of the adhering element 306 towards the second film 21 when it is determined, by means of the detector 308*d*, that said adhering element 306 is in said adhering position P2, such that the correct position is always assured so that the adhering element 306 comes into contact with said second film 21, thereby assuring correct contact between said adhering element 306 and said second film 21. The detector 308*d* can be an inductive-type detector, for example, the support 307 and/or adhering element 306 comprising the necessary properties so that the detector 308*d* can detect the presence thereof. Although the presence of at least two actuators acting in a non-simultaneous manner when the adhering element 306 is separated from the second film 21 has been mentioned, both actuators could also act simultaneously for said separation, or the splicing unit 3 could even comprise a single actuator for such purpose (the same actuator for moving the adhering element 306 closer to the second film 21 and separating it from same).

The splicing unit 3 further comprises at least one hold-down element 309, preferably a hold-down element 309 on each side of the adhering element 306, configured for holding down or securing the second film 21 in place, at least while the adhesive element 4 is adhered to said second film 21. It is therefore assured that the second film 21 does not move while the adhesive element 4 is being adhered to it, assuring that said adhesive element 4 is correctly adhered to said second film 21. The hold-down element 309 moves independently with respect to the adhering element 306, such that during the vertical movement of said adhering element 306 the second film 21 also remains held down by the hold-down element 309, as depicted in FIG. 7 (the support 307 is not depicted in FIG. 7 for the sake of clarity).

The support 307 comprises a cover 307*a* cooperating with the structure 308 when said support 307 is in the adhering position P2, preventing access to the inside of the support 307 and therefore preventing access to the adhering element 306. The user is therefore prevented from acting on the adhering element 306 when it is in the adhering position P2, assuring to a greater extent correct adhesion of the adhesive element 4 on the second film 21 and preventing risks of the user getting caught in same. For example, the structure 308 can comprise housings 308*a* and the cover 307*a* can comprise projections 307*b* housed in said housings 308*a*. In the other positions of the support 307, the cover 307*a* does not cooperate with the structure 308, the cover being able to be moved for accessing the adhering element 306.

Another aspect relates to a horizontal packaging machine 1000 where the method of the first aspect is implemented.

Another aspect relates to a horizontal packaging machine 1000 comprising a splicing unit 3 like the one of the second aspect.

According to some implementations methods consistent with clauses 1-6 below are employed to facilitate a splicing of an active film and spare film of a packaging machine. Further, according to other implementations apparatus consistent with clauses 7-15 below are provided to facilitate a splicing of an active film and spare film of a packaging machine.

Clause 1: Splicing method for splicing two packaging films for a horizontal packaging machine, whereby a first packaging film (11) being used in the packaging machine (1000) for packaging the products is spliced to a second packaging film (21), which is a spare film, by means of an adhesive element (4) comprising a first adhesive surface which is adhered to the second film (21) and a second adhesive surface opposite the first adhesive surface and which is adhered to the first film (11), characterized in that in the method the second adhesive surface of the adhesive element (4) is adhered to an adhering element (306) of the packaging machine (1000), the first adhesive surface of said adhesive element (4) being exposed; the adhering element (306) moves to a position in which said first adhesive surface of the adhesive element (4) comes into contact with the second film (21) for being adhered to same; the adhering element (306) is separated from the second film (21) such that the second adhesive surface of the adhesive element (4) is peeled off said adhering element (306) and the adhesive element (4) is adhered to said second film (21) with the second adhesive surface exposed; and contact between the first film (11) and said exposed second adhesive surface of the adhesive element (4) is caused for splicing both films (11, 21) to one another by means of the adhesive element (4).

Clause 2: Splicing method according to clause 1, wherein the second film (21) is secured to keep it in place at least from the time the first adhesive surface of the adhesive element (4) comes into contact with the second film (21), until the adhering element (306) is completely separated from said second film (21).

Clause 3: Splicing method according to clause 1 or 2, wherein the movement of the adhering element (306) to separate it from the second film (21) is performed by separating one end of said longitudinal adhering element (306) from said second film (21) before the other end.

Clause 4: Splicing method according to any of clauses 1 to 3, wherein the adhering element (306) moves from an initial position (P0) to an access position (P1) where a main surface of said adhering element (306) on which said second adhesive surface is adhered is accessible by a user for adhering the second adhesive surface of the adhesive element (4) to said adhering element (306), said adhering element (306) then moving to the initial position (P0) and from said initial position (P0) to the position in which the first adhesive surface of the adhesive element (4) comes into contact with the second film (21).

Clause 5: Splicing method according to clause 4, wherein the splicing unit (3) comprises a support (307) for housing the adhering element (306), which is attached to a structure (308) with freedom of transverse movement in a positioning direction (X), said adhering element (306) performing a longitudinal movement with respect to said support (307) to go from the initial position (P0) to the access position (P1) and vice versa, a transverse movement in the positioning direction (X) integral with the support (307) from the initial position (P0) to a adhering position (P2) in which the main surface of the adhering element (306) is facing the second film (21), and a vertical movement of said adhering element (306) with respect to the support (307) towards said second film (21) until coming into contact with it and vice versa.

Clause 6: Splicing method according to clause 5, wherein the vertical movement of the adhering element (6) with respect to the support (307) towards the second film (21) is caused once it has been detected by means of a corresponding detector (308*d*) that the support (307) and/or adhering element (306) are in the corresponding adhering position (P2).

Clause 7: Splicing unit for splicing two packaging films for a horizontal packaging machine, the packaging machine (1000) comprising a first reel holder (1) for supporting a first film (11) wound in the form of a reel (12), and a second reel holder (2) for supporting a second film (21) wound in the form of a reel (22), the first film (11) being the film being used in the packaging machine (1000) for packaging the products and the second film (21) being a spare film, said splicing unit (3) splicing both films (11, 21) to one another by means of an adhesive element (4) comprising a first adhesive surface which is adhered to the second film (21) and a second adhesive surface opposite the first adhesive surface and which is adhered to the first film (11), characterized in that the splicing unit (3) comprises an adhering element (306) for adhering the first adhesive surface of the adhesive element (4) to the second film (21), and splicing means to cause contact between the two films (11, 21), the adhering element (306) comprising a main surface on which the second adhesive surface of the adhesive element (4) is adhered, said adhering element (306) being suitable for moving in a guided manner to a position in which the first adhesive surface of the adhesive element (4) comes into contact with the second film (21) for being adhered to same, and for being separated from said second film (21) such that the second adhesive surface of the adhesive element (4) is peeled off said adhering element (306) and the adhesive element (4) is adhered to said second film (21) with the exposed second adhesive surface, and the splicing means being configured to cause contact between the two films (11, 22) when the first adhesive surface of the adhesive element (4) is adhered to the second film (21), for splicing both films (11, 21) to one another by means of said adhesive element (4).

Clause 8: Splicing unit according to clause 7, wherein the adhering element (306) and/or adhesive element (4) are configured so that the bond strength between the second film (21) and the first adhesive surface of said adhesive element (4) adhered to said second film (21) is greater than the bond strength between the main surface of the adhering element (306) and the second adhesive surface of said adhesive element (4) adhered to said main surface of the adhering element (306).

Clause 9: Splicing unit according to clause 8, wherein the two adherent surfaces of the adhesive element (4) comprise the same adhesive properties, the main surface of the adhering element (306) comprising adherent properties that are inferior to the adherent properties of the second film (21).

Clause 10: Splicing unit according to any of clauses 7 to 9, comprising a first actuator (31) associated with a first end of the adhering element (306) and a second actuator associated with a second end of the adhering element (306), opposite the first end of the adhering element (306), and control means communicated with both actuators, said actuators causing a movement of the adhering element (306) for moving it closer to and away or separating it from the second film (21), and said control means being configured to cause simultaneous actuation of both actuators for moving the adhering element (306) closer to the second film (21), and delayed actuation of one of the actuators with respect to the actuation of the other actuator for moving or separating said adhering element (306) away from said second film (21).

Clause 11: Splicing unit according to any of clauses 8 to 10, comprising at least one hold-down element (309) configured for holding down the second film (21), at least while the adhesive element (4) is adhered to said second film (21), to keep it in place.

Clause 12: Splicing unit according to any of clauses 7 to 11, wherein the adhering element (306) is suitable for moving from an initial position (P0) to an access position (P1) where a main surface of said adhering element (306) on which said second adhesive surface is adhered is accessible by a user for adhering the second adhesive surface of the adhesive element (4) to said adhering element (306), and vice versa.

Clause 13: Splicing unit according to clause 12, comprising a support (307) for housing the adhering element (306), which is configured for moving guided by a structure (308) of the splicing unit (3) in a positioning direction (X) transverse to the adhering element (306), said adhering element (306) being attached to said support (307) with freedom of longitudinal movement, said adhering element (306) being suitable for moving longitudinally with respect to said support (307) to go from the initial position (P0) to the access position (P1) and vice versa, for moving, integral with the support (307), from the initial position (P0) to a adhering position (P2) in which the main surface of the adhering element (306) is facing the second film (21), and for moving, with respect to the support (307), from said adhering position (P2) to the second film (21) and vice versa.

Clause 14: Splicing unit according to clause 13, comprising a detector (308*d*) for detecting if the adhering element (306) and/or support (307) is in the adhering position (P2), and control means communicated with said detector (308*d*), said control means being configured to cause the movement of the adhering element (306) towards the second film (21) when they determine, by means of the detector (308*d*), that said adhering element (306) and/or support (307) is in said adhering position (P2).

Clause 15: Splicing unit according to clause 14, wherein the support (307) comprises a cover (307*a*) cooperating with at least one housing (308*a*) of the structure (308) when said support (307) is in the adhering position (P2), preventing access to the inside of the support (307) and therefore preventing access to the adhering element (306).

What is claimed is:

1. A method for splicing an active film with a spare film of a packaging machine by use of an adhesive element that has a first side with a first adhesive surface and a second side with a second adhesive surface, the first side being opposite the second side, the packaging machine including an elongate adhering element having a longitudinal axis, the adhering element being movable along a first path and a second path different than the first path, the adhering element movable along the first path between a first position and a second position, the adhering element having a first end portion and a second end portion: the method comprising:

attaching the adhesive element to a main surface of the adhering element by placing the second adhesive surface in contact with the main surface of the adhering element;

moving the adhering element along the second path while the adhering element is in the first position to place the adhesive element at a designated location above the spare film;

moving the adhering element from the first position to the second position to cause the first adhesive surface of the adhesive element to contact and bond with the spare film;

separating the adhering element from the second adhesive surface by moving the adhering element from the second position to the first position; and placing the active film in contact with the second adhesive surface to attach the active film to the spare film.

2. The method according to claim 1, further comprising a step of holding the spare film in position by use of a hold element after the first adhesive surface of the adhesive element has been placed in contact and bonded with the spare film.

3. The method according to claim 2, wherein the step of holding the spare film continues until the adhering element is separated from the second adhesive surface of the adhesive element.

4. The method according to claim 1, wherein the separating of the adhering element from the adhesive element includes separating the adhesive element from the first end portion and thereafter separating the adhesive element from the second end portion.

5. The method according to claim 1, wherein the adhering element does not move from the first position to the second position to cause the first adhesive surface of the adhesive element to contact and bond with the spare film until a determination is made by the use of a detector that the adhering element is at the designated location above the spare film.

6. The method according to claim 1, wherein the adhesive element is caused to more strongly bond to the spare film than to the surface of the adhering element.

7. The method according to claim 1, wherein the each of the first and second paths is a linear path and the second path is perpendicular to the first path.

8. The method according to claim 1, wherein the first path is vertically oriented and the second path is horizontally oriented.

9. The method according to claim 1, wherein the adhering element is movable between first and second longitudinal positions, in the first longitudinal position the main surface of the adhering element resides inside a support, in the second longitudinal position the main surface of the adhering element resides outside the support, the method further comprising moving the adhering element from the first longitudinal position to the second longitudinal position prior to attaching the adhesive element to the main surface.

* * * * *